US010316378B2

(12) United States Patent
Fortin et al.

(10) Patent No.: US 10,316,378 B2
(45) Date of Patent: Jun. 11, 2019

(54) APPARATUS FOR QUENCHING

(71) Applicants: Safran Landing Systems UK LTD, Gloucester, Gloucestershire (GB); Safran Landing Systems Canada Inc., Ajax (CA)

(72) Inventors: Rejean Fortin, Hawkesbury (CA); Yachoa Wang, Cheltenham (GB); Abdallah Boukhchacha, Montreal (CA)

(73) Assignees: Safran Landing Systems Canada Inc. (CA); Safran Landing Systems UK LTD (GB)

( * ) Notice: Subject to any disclaimer, the term of this patent is extended or adjusted under 35 U.S.C. 154(b) by 263 days.

(21) Appl. No.: 15/029,828

(22) PCT Filed: Oct. 17, 2014

(86) PCT No.: PCT/GB2014/053122

§ 371 (c)(1),
(2) Date: Apr. 15, 2016

(87) PCT Pub. No.: WO2015/056029

PCT Pub. Date: Apr. 23, 2015

(65) Prior Publication Data

US 2016/0237516 A1 Aug. 18, 2016

(30) Foreign Application Priority Data

Oct. 18, 2013 (GB) ..... 1318462.7

(51) Int. Cl.

| | |
|---|---|
| ***C21D 1/667*** | (2006.01) |
| ***C21D 1/63*** | (2006.01) |
| ***C21D 1/56*** | (2006.01) |

(52) U.S. Cl.
CPC ..... *C21D 1/667* (2013.01); *C21D 1/56* (2013.01); *C21D 1/63* (2013.01)

(58) Field of Classification Search
CPC ..... C21D 1/667; C21D 1/62; C21D 1/63
See application file for complete search history.

(56) References Cited

U.S. PATENT DOCUMENTS

| | | | | |
|---|---|---|---|---|
| 1,587,194 A | | 6/1926 | Sladden | |
| 3,807,714 A | * | 4/1974 | Hollyer | C21D 1/667 266/134 |

(Continued)

FOREIGN PATENT DOCUMENTS

| | | |
|---|---|---|
| GB | 1347445 | 2/1974 |
| WO | 9307301 | 4/1993 |

OTHER PUBLICATIONS

International Search Report for Application No. PCT/GB2014/053122 dated Jan. 23, 2015, 2 pages.

*Primary Examiner* — Scott R Kastler
(74) *Attorney, Agent, or Firm* — RatnerPrestia

(57) ABSTRACT

A quenching agent delivery apparatus is provided for delivering a quenching agent to a component to be quenched. The delivery apparatus comprises an inlet through which the quenching agent is configured to be delivered into the apparatus, a first outlet configured to deliver quenching agent in a first direction to an inner surface of the component, and a second outlet configured to deliver quenching agent in a second direction to an inner surface of the component.

13 Claims, 5 Drawing Sheets

(56) References Cited

U.S. PATENT DOCUMENTS

| | | | | |
|---|---|---|---|---|
| 4,123,301 | A * | 10/1978 | Pope | C21D 1/667<br>148/508 |
| 5,529,290 | A | 6/1996 | Drager | |
| 2013/0292495 | A1* | 11/2013 | Palle | A62C 31/05<br>239/463 |
| 2016/0237516 | A1* | 8/2016 | Fortin | C21D 1/63 |

* cited by examiner

APPARATUS FOR QUENCHING

This application is a U.S. National Phase application of PCT International Application No. PCT/GB2014/053122, filed Oct. 17, 2014, which claims the benefit of GB 1318462.7, filed Oct. 18, 2013, both of which are incorporated by reference herein.

TECHNICAL FIELD OF THE INVENTION

This invention relates to quenching components and, more particularly, to a quenching system, a quenching agent delivery apparatus and a method of quenching a component.

BACKGROUND TO THE INVENTION

Quenching is a well known technique used to rapidly cool a machined work piece. Quenching is used readily in the manufacture of metal work pieces. A quenching process may be used to cool a metal work piece after the work piece has been heated to a high temperature for shaping or manipulating it in some way, for example to strengthen it.

In a known quenching system, a quenching tank is filled with a quenching agent, for example water or oil. A component to be quenched is then submerged in the quenching agent in the quenching tank so that the surface of the component is in contact with the quenching agent.

Some components that need to be quenched are hollow and, to ensure that inner surfaces of the component are quenched along with the outer surface of the component, it is necessary for the quenching agent to come into contact with the inner surface.

It is important that, when a component is placed in the quenching agent, the quenching agent comes into contact with the entire inner surface of the component. If the portion of a surface of a component is not quenched following a heat treatment process, or if a portion of the surface is quenched less than another portion of the surface, then there can be uneven quenching of the component.

SUMMARY OF INVENTION

According to a first aspect, the present invention provides a quenching agent delivery apparatus for delivering a quenching agent to a component to be quenched, the apparatus comprising an inlet through which the quenching agent is configured to be delivered into the apparatus; a first outlet configured to deliver quenching agent in a first direction to an inner surface of the component; and a second outlet configured to deliver quenching agent in a second direction to an inner surface of the component. The second direction may be at an angle of approximately 45 degrees with respect to the first direction.

A deflector may be located within the apparatus configured to deflect a proportion of the quenching agent entering the apparatus through the inlet to exit the apparatus through the second outlet.

The deflector may be configured to allow a proportion of the quenching agent entering the apparatus through the inlet to be delivered to, and exit the apparatus through, the first outlet.

The deflector may comprise at least one aperture, the at least one aperture being sized and shaped to allow a predetermined amount of quenching agent to pass therethrough. The at least one aperture may be configured to allow between around 15 percent and 30 percent of quenching agent flowing into the apparatus via the inlet to be delivered to, and exit the apparatus through, the first outlet. The at least one aperture may comprise a single circular aperture.

The delivery apparatus may be elongate and may define a longitudinal axis. The deflector may be inclined at an angle of around 45 degrees with respect to the longitudinal axis.

A seal may be formed around a periphery of the apparatus. The seal may be configured such that, when the apparatus is installed in a component, the amount of quenching agent able to flow between the apparatus and component is restricted.

According to a second aspect, the present invention provides a quenching system comprising: a quenching tank configured to contain a quenching agent; a conduit configured to transport the quenching agent; and a quenching agent delivery apparatus according to any of the preceding claims, the quenching agent delivery apparatus being connected to a first end of the conduit.

The quenching agent delivery apparatus may be configured to remain stationary relative to the component during quenching.

The delivery apparatus may comprise a seal sized to allow a predetermined amount of quenching agent to pass between the component and the delivery apparatus. The delivery apparatus may further comprise a pump for pumping said quenching agent through the conduit.

The delivery apparatus may comprise a coupler for coupling the conduit between the pump and the quenching agent delivery apparatus.

According to a third aspect, the present invention provides a method of quenching a component, the method comprising: inserting at least partially into the component a quenching agent delivery apparatus, the delivery apparatus having a first outlet and a second outlet; connecting the delivery apparatus to a conduit through which quenching agent is configured to flow; placing the component and the delivery apparatus into a quenching tank containing quenching agent; and pumping the quenching agent through the conduit and delivery apparatus into the component via the first outlet and the second outlet.

Other advantageous features will be apparent from the following description.

BRIEF DESCRIPTION OF THE DRAWINGS

Embodiments of the invention will now be described, strictly by way of example only, with reference to the accompanying drawings, of which.

DESCRIPTION OF THE EMBODIMENTS

Figure 1:
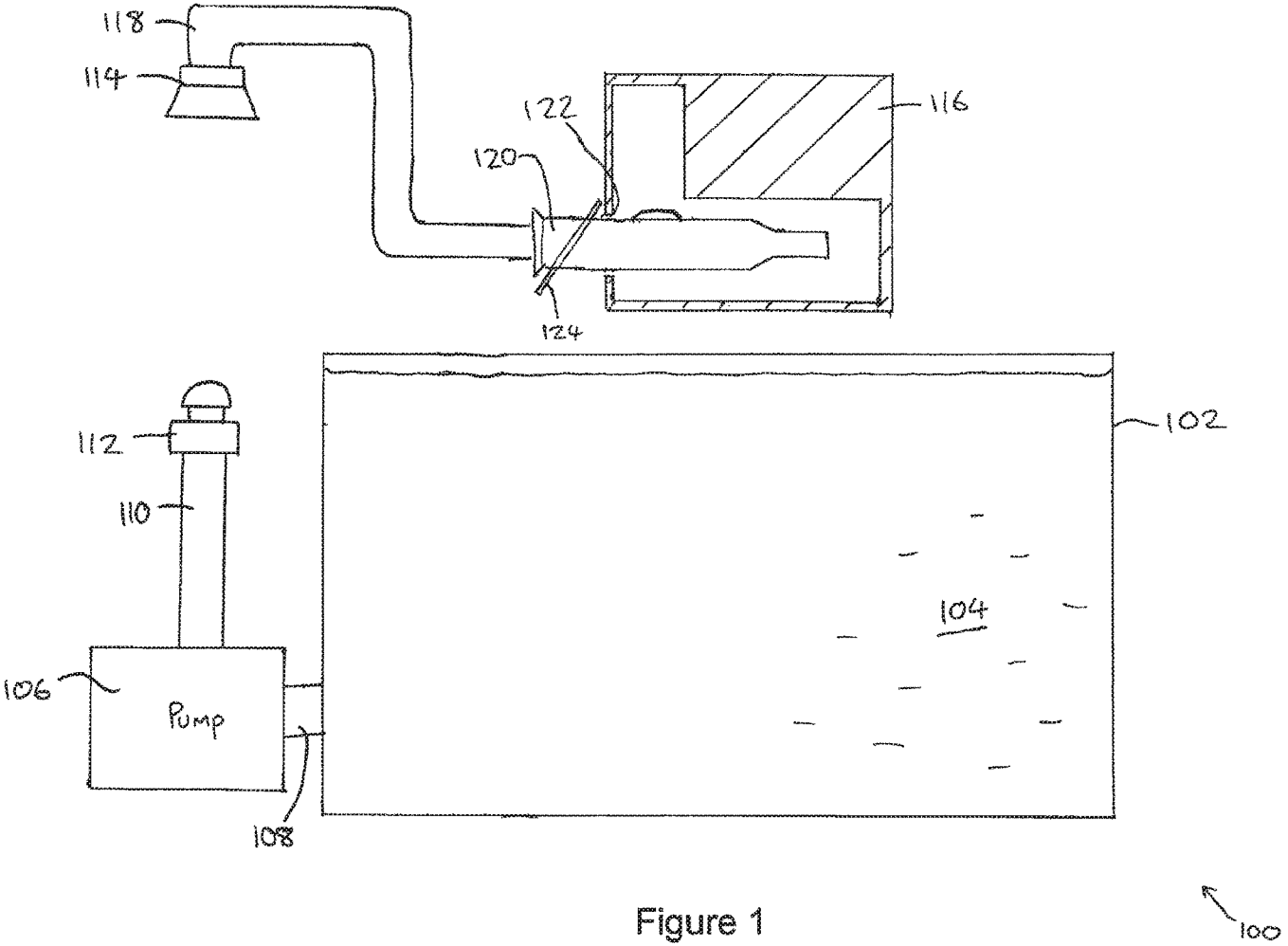
FIG. 1 is a schematic drawing of a quenching system constructed in accordance with an embodiment of the present invention.

Referring to the drawings, FIG. 1 shows a quenching system, labeled generally as 100, which includes a quenching tank 102 containing a quenching agent 104. A pump 106 is connected to the quenching tank 102 via a hose or conduit 108. A delivery conduit 110 is connected at a first end to the pump 106 and at a second end to a docking port 112. The docking port 112, which will be described in more detail below, is configured to be received by and dock with a docking socket 114 so as to allow quenching agent 104 to flow into a component to be quenched 116. The docking socket 114 is connected via a delivery pipe or conduit 118 which in turn is connected to a quenching agent delivery apparatus 120. The apparatus 120 for delivering quenching agent to the component 116 is in the form of a nozzle and will be described in greater detail below. The delivery apparatus 120 is inserted into the component 116 through an aperture or opening 122 in the component.

The component 116 is shown in FIG. 1 as a generally rectangular component having a generally L-shaped cavity formed therein. The component to be quenched 116 may be a generally tubular component which is used in an aircraft landing gear. However, it will be appreciated that any other component that requires quenching could be quenched using this system.

While the present invention is particularly advantageous for quenching components having a generally L-shaped cavity, it will be appreciated that the invention could be used with components of any shape which are hollow or have a cavity formed therein and an opening through which quenching agent can pass in order to reach internal surfaces of the component.

In the exemplary system 100 shown in FIG. 1, in order to carry out the quenching process, the component 116, the delivery apparatus 120, the delivery pipe 118 and the docking socket 114 are lowered towards the quenching agent 104 in the quenching tank 102. The system 100 is arranged such that the docking socket 114 and the docking port 112 are completely submerged in the quenching agent 104 after they engage one another. It will be appreciated that additional components (not shown) will be required to lower the component into the quenching tank. For example, a crane, counterweight and pulley system might be used to lower the component into, and raise the component out of, the quenching tank. Furthermore, additional components (not shown) might be used to align the component and to align the docking socket 114 with the docking port 112 as the component is lowered into the quenching tank.

In use, the quenching agent delivery apparatus 120 is partially inserted into the component to be quenched 116, and connected in position in the manner described below with reference to FIG. 2. The delivery apparatus 120 is connected to the delivery pipe 118 which, in turn, is connected to the docking socket 114. When the component 116 undergoes its heat treatment prior to being quenched, the delivery apparatus 120, the delivery hose 118 and the docking socket 114, which are connected to the component, also undergo the heat treatment. By connecting the delivery apparatus 120 to the component 116 prior to the heat treatment process, the time taken to move the component from the heat treatment furnace to the quenching tank 102 can be kept as short as possible. Since the delivery apparatus 120, the delivery pipe 118 and the docking socket 114 are already connected to the component 116, immediately following the heat treatment process, the heat treated component can be lowered into the quenching agent 104 in the quenching tank 102. As the component 116 is lowered into the quenching tank 102, the docking socket 114 engages with the docking port 112, and the relative configurations of the docking socket and port assist the correct alignment. As the component 116 is submerged into the quenching agent 104, the engaged docking socket 114 and docking port 112 are also lowered into the quenching agent. The pump 106 is activated as the delivery apparatus 120 is lowered into the quenching agent 104. Ideally, the flow of quenching agent 104 via the pump 106 begins as soon as the component 116 comes into contact with the quenching agent. In this way, the flow of quenching agent 104 internally and externally with respect to the component 116 is balanced during immersion of the component.

Consequently, the heat transfer coefficients of the internal and external surfaces of the component 116 are balanced as the component is immersed. The pump 106 pumps quenching agent 104 from the quenching tank 102, via the hose 110, through the docking port 112 and docking socket 114, through the delivery pipe 118, and into the delivery apparatus 120. The flow of quenching agent 104 through and out of the delivery apparatus 120 will now be discussed in greater detail, with reference to FIG. 2.

Figure 2:
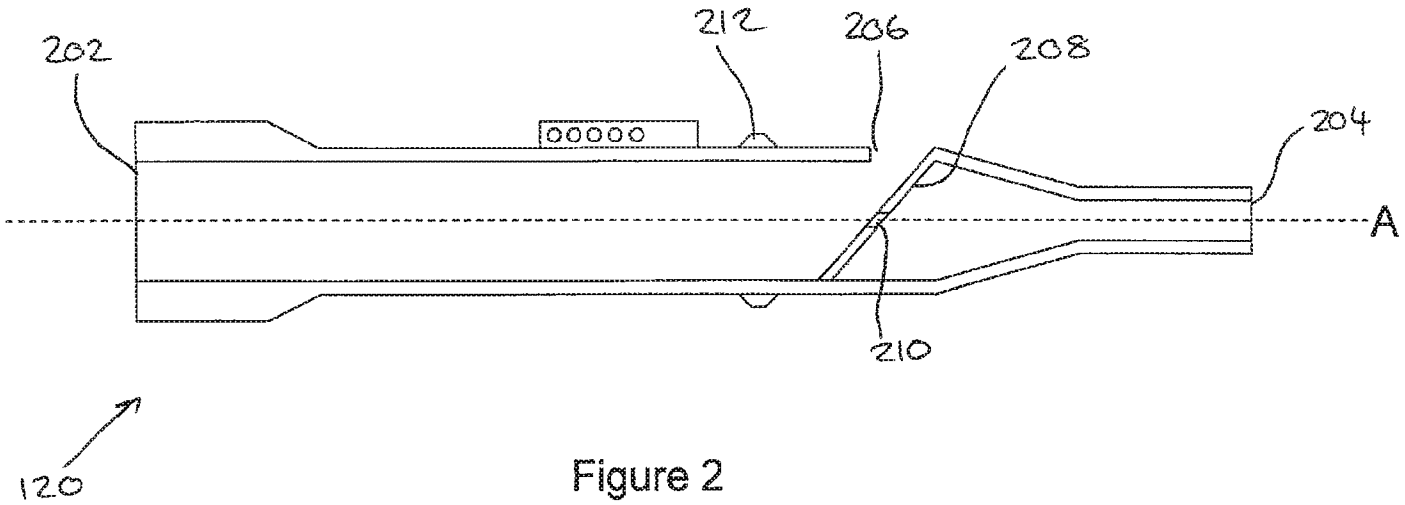
FIG. 2 is a sectional view of an apparatus for delivering quenching agent to a component to be quenched, constructed in accordance with an embodiment of the present invention.

FIG. 2 is a cross sectional view of the quenching agent delivery apparatus 120, which takes the form of a nozzle, and allows quenching agent to be delivered to internal surfaces of a hollow component or a component having a cavity formed therein.

The delivery apparatus 120 is generally tubular in shape, defining a longitudinal axis A. The delivery apparatus 120 has an inlet 202 via which quenching agent 104 is able to flow from the delivery pipe 118 (see FIG. 1) into the delivery apparatus. A first outlet 204 is formed at an end of the delivery apparatus 120 opposite to the inlet 202. A second outlet 206 is formed in a wall of the delivery apparatus 120. The first outlet 204 and the second outlet 206 allow quenching agent 104 to flow out of the delivery apparatus 120 in two different directions, namely in a first direction substantially along the longitudinal axis A (via the first outlet 204) and in a second direction at an angle of around 45 degrees to around 90 degrees relative to the longitudinal axis A (via the second outlet 206).

A deflector 208 is located within the delivery apparatus 120 and is arranged to deflect a portion of quenching agent 104 flowing through the delivery apparatus through the second outlet 206. One or more apertures 210 formed in the deflector 208 allow a portion of quenching agent 104 flowing through the delivery apparatus 120 to flow beyond the deflector to the first outlet 204. The size of the aperture 210 formed in the deflector 208 or, where a plurality of apertures are formed in the deflector, the size and configuration of the plurality of apertures, can be selected to allow a particular proportion of quenching agent 104 flowing into the delivery apparatus 120 to flow through the deflector 208 to the first outlet 204. Some possible configurations of apertures 210 formed in the deflector 208 will be discussed in more detail with reference to FIGS. 3A to 3G below.

As will be apparent from FIG. 2, the diameter of the first outlet 204 is smaller than the diameter of the inlet 202 of the delivery apparatus 120. The diameters or sizes of the first outlet 204 and the second outlet 206 are chosen to increase or decrease the speed of the quenching agent 104 leaving the delivery apparatus via the outlets 204, 206. In other words, reducing the diameter of the outlet 204 will result in an increase of the speed at which quenching agent 104 exits the delivery apparatus 120 via the first outlet. If the first outlet 204 has a larger diameter, the quenching agent 104 would exit the delivery apparatus 120 at a relatively lower speed.

In some embodiments, a seal 212 is formed around the circumference of the delivery apparatus 120. The seal 212 is positioned such that when the end of the delivery apparatus 120 at which the first and second outlets 204, 206 are located is inserted through the opening 122 in the component 116 to be quenched the seal engages the component around the opening and restricts the amount of quenching agent 104 able to leave the component through the opening. The amount of quenching agent 104 able to leave the component 116 via the opening 122 is selected to ensure that a sufficient pressure of quenching agent within the component is maintained. In other words, if it is desirable to have a high pressure of quenching agent 104 within the cavity of the component 116 during quenching, then a relatively larger seal 212 is fitted to the delivery apparatus 120, thereby restricting the amount of quenching agent able to exit the component 116 via the opening 122 around the outside of the delivery apparatus. However, if a relatively lower pressure of quenching agent is required within the cavity of the component 116 during quenching, then a relatively smaller seal 212 is fitted to the delivery apparatus 120, thereby allowing more quenching agent 104 to leave the cavity of the component via the opening through which the delivery apparatus is inserted. In other embodiments, the delivery apparatus 120 is not provided with a seal. In embodiments where no seal is provided, the pressure of the quenching agent 104 within the component 116 can be maintained at a desired level by increasing or decreasing as required the flow rate of quenching agent injected into the component 116. A further advantage of the component not having a seal is that hot quenching agent 104 from within the component 116 can more easily exit the component via the opening 122, thereby reducing the temperature of quenching agent within the component.

The delivery apparatus 120 may, in some embodiments, include an external deflector 124, which is formed around the circumference of the apparatus 120, and serves to deflect quenching agent 104 exiting the component 116 via the opening 122 downwards into the quenching tank 102. If quenching agent 104 is injected into the component 116 at a fast rate. then the hot quenching agent exiting the component will also be travelling at a fast rate. Therefore, the provision of the external deflector 124 reduces the chance of damage occurring to nearby equipment, and injuries occurring to users of the system 100 as a result of spray or splashes of hot quenching agent.

As mentioned above with reference to FIG. 2, the deflector 208 may be formed with one or more apertures formed therein in a number of different configurations. FIGS. 3A to 3G show various configurations of apertures that may be formed in the deflector plate. Each of FIGS. 3A to 3G is a sectional view through the delivery apparatus 210, along the direction of the longitudinal axis A. The deflector 208 is shown transparent for clarity and, therefore, the first outlet 204 is visible. In FIGS. 3A to 3G, the delivery apparatus 120 is oriented as it is shown in FIG. 2, with the second outlet 206 (not shown in FIGS. 3A to 3G) at the top of the delivery apparatus.

Figure 3A:
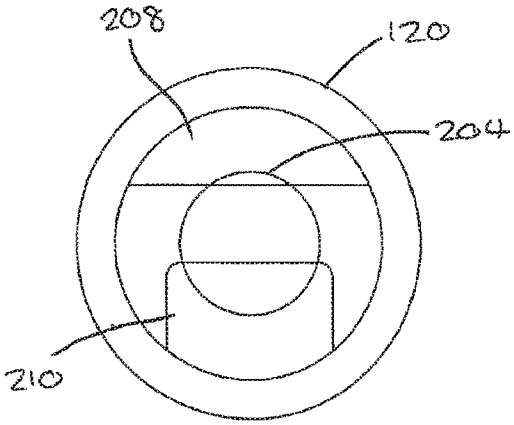
FIGS. 3A to 3G are sectional views of the apparatus of FIG. 2, showing various configurations of a deflector plate.

In FIG. 3A, a single aperture 210 is formed at an edge at the bottom of the deflector 208. The area of the aperture 210 forms 20% of the total circular cross sectional area of the deflector 208.

Figure 3B:
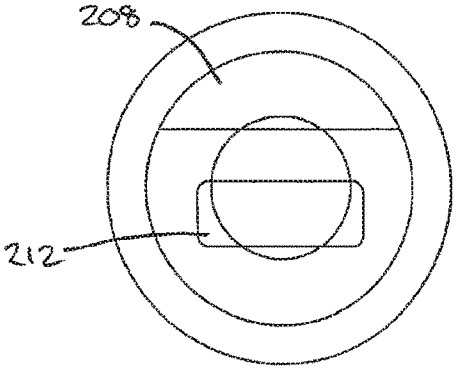

In FIG. 3B, a single aperture 212 is formed away from the edges of the deflector 208. The area of the aperture 212 forms 20% of the total circular cross sectional area of the deflector 208.

Figure 3C:
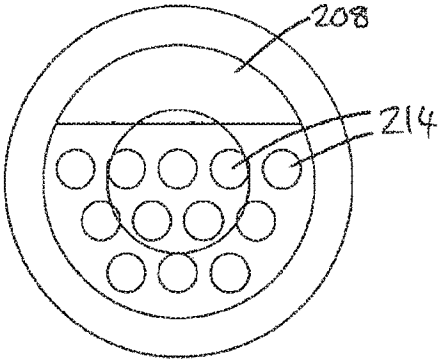

In FIG. 3C, a plurality of substantially circular apertures 214 are formed in an array in the deflector 208. The total area of the apertures 214 forms 20% of the total cross sectional area of the deflector 208. In the arrangement shown in FIG. 3C, the array is formed of twelve circular apertures 214 formed in a first row of five apertures, a second row of four apertures, and a third row of three apertures. However, other arrangements would be envisaged by those skilled in the art.

Figure 3D:
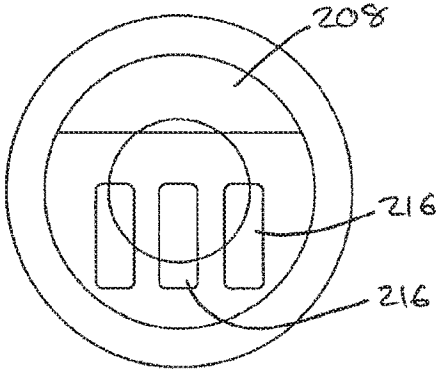

In FIG. 3D, a plurality of three elongate apertures 216 are formed in the deflector 208. The apertures 216, in this arrangement, are vertical apertures, and are arranged adjacent to one another. The total area of the apertures 216 forms 15% of the total circular cross sectional area of the deflector 208.

Figure 3G:
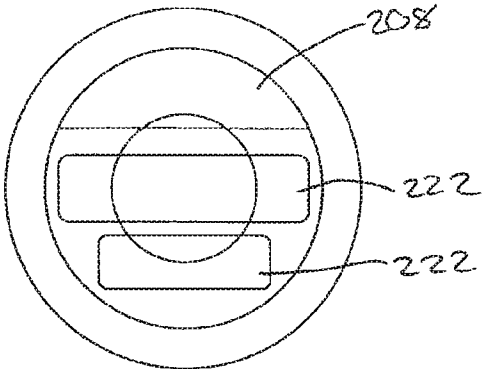
Figure 3E:
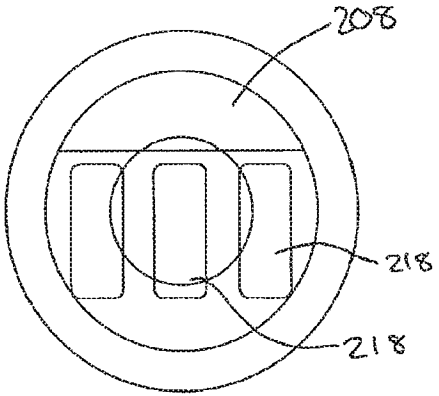

In FIG. 3E, a plurality of elongate apertures 218 are formed in the deflector 208. The apertures 218 in this arrangement are similar to the apertures 216 shown in FIG. 3D. However, in FIG. 3E, the apertures 218 are longer than the apertures 216 of FIG. 3D. Accordingly, the total area of the apertures 218 forms 20% of the total circular cross sectional area of the deflector 208.

Figure 3F:
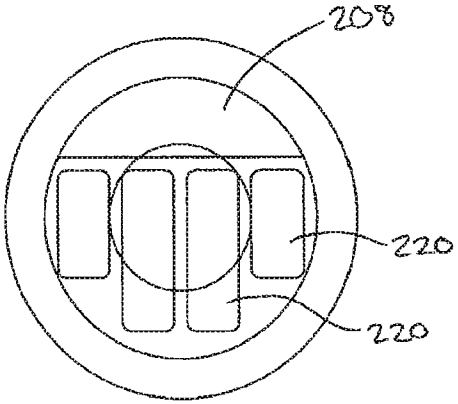

In FIG. 3F, a plurality of apertures 220 are formed in the deflector 208. The apertures 220 are similar in shape to the apertures shown in FIG. 3E. However, in the arrangement shown in FIG. 3F, four elongate apertures 220 are formed in the deflector 208. The total area of the apertures 220 forms 30% of the total circular cross sectional area of the deflector 208.

In FIG. 3G, a plurality of apertures 220 are formed in the deflector 208. In this arrangement, two elongate horizontally-oriented apertures 222 are formed in the deflector 208, one above the other. The total area of the apertures 222 forms 20% of the total circular cross sectional area of the deflector 208.

In FIGS. 3A to 3G, the apertures 210, 212, 214, 216, 218, 220, 222 are shown having particular shapes, orientations and sizes. Where multiple apertures are formed in the deflector 208, they are shown having particular arrangements and configurations. It will be appreciated by those skilled in the art that these are merely examples of possible configurations of apertures that could be formed in the deflector 208 in order to achieve the desired effect. For example, where it is desirable to allow 20% of the quenching agent 104 reaching the deflector 208 to pass through the apertures, a large number of alternative arrangements of apertures could be used to achieve the required through-flow of quenching agent. The particular arrangements of apertures described above are advantageous as they allow the desired amount of quenching agent 104 to pass through the deflector 208, while ensuring that the quenching agent continues to flow relatively uniformly after it has passed through the deflector 208. If quenching agent 104 passes through the deflector 208 and fails to flow relatively uniformly along the delivery apparatus 120, then there exists the risk that some of the quenching agent 104 in the delivery apparatus 120 will remain stationary, resulting in inefficient heat removal from either the component being quenched 116 or from the delivery apparatus 120 itself. If heat is not removed evenly and in a timely manner from the component 116 or the delivery apparatus 120 by the quenching agent 104, then the risk of uneven quenching of the component is increased.

In the embodiments shown in FIGS. 3A to 3G, the apertures in the deflector 208 form between 15% and 30% of the total circular cross sectional area of the deflector. The percentage of the total circular cross sectional area of the deflector formed by apertures can be chosen depending on the amount of quenching agent 104 desired to exit the delivery apparatus 120 via the first outlet 204 and via the second outlet 206. For example. if a larger percentage of the quenching agent 104 is required to exit the delivery apparatus 120 via the first outlet 204, then a deflector having a greater number of apertures, and/or larger apertures, can be used.

A deflector having a single round aperture allows a through-flow of quenching agent 104 which reaches a steady state in the delivery apparatus 120 in the shortest time. Thus, in some embodiments, a deflector 208 is provided with a single circular aperture.

Figure 4:
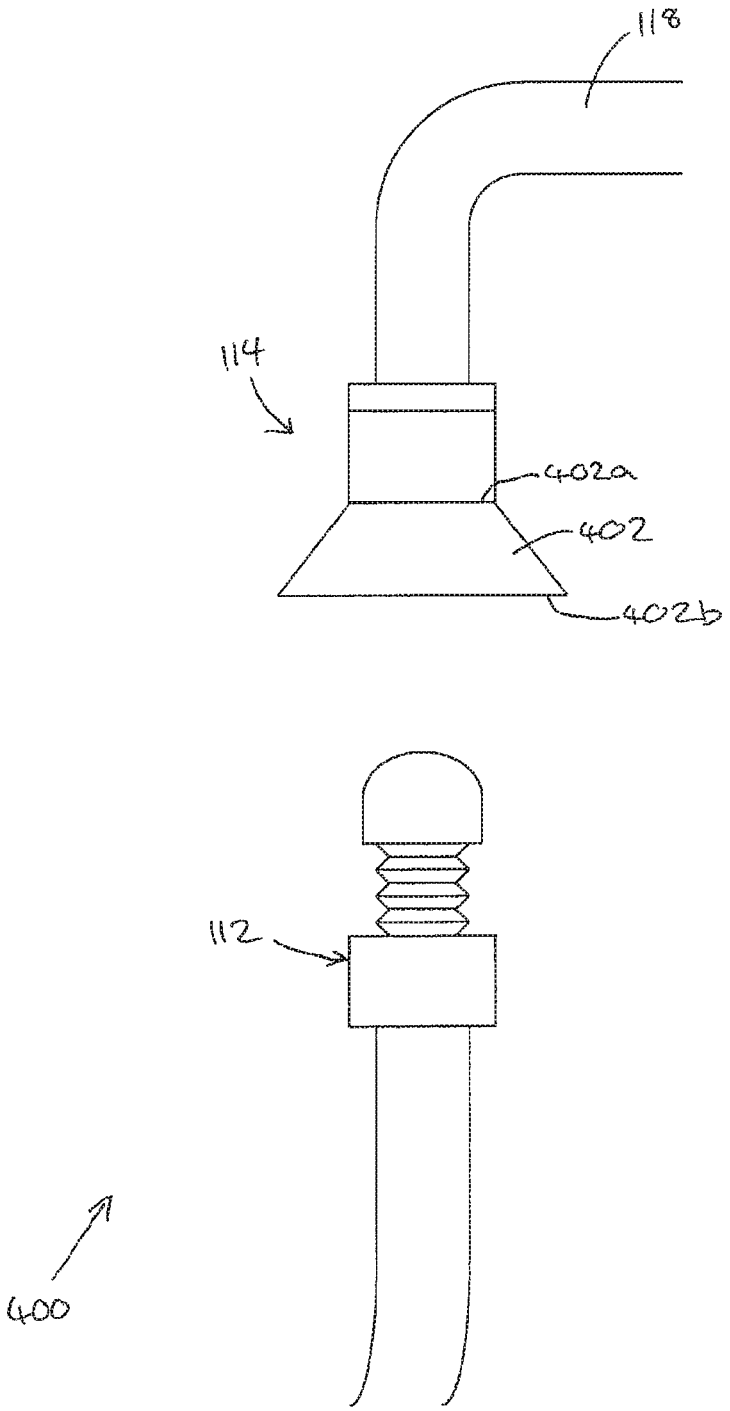
FIG. 4 is a schematic diagram of a docking system for use in the quenching system of FIG. 1.

FIG. 4 shows a docking system 400 which includes the docking port 112 and the docking socket 114. The docking system 400 acts as a coupler and serves to couple the pump 106 to the delivery apparatus 120 via the delivery conduit 110 and the delivery pipe 118. As is discussed above with reference to FIG. 1, the docking port 112 is connected to a delivery conduit 110, through which quenching agent 104 can be pumped by the pump 106. The docking socket 114 is connected to the delivery apparatus 120 via the delivery pipe 118.

The docking socket 114 includes a funnel portion 402 having a first end 402*a*, which connects to the delivery pipe 118, and a second end 402*b*, which is larger than the first end, and through which the docking port 112 can be received. Thus, the docking socket 114 is generally frusto-conical in shape. The relatively larger opening 402*b* of the docking socket 114 serves to allow easier engagement with the docking port 112. As the docking socket 114 is lowered onto the docking port 112, the funnel portion of the docking socket guides the docking port into the docking socket so that, even if the port and socket are not perfectly aligned, the port is guided into the correct alignment.

The automatic aligning of the docking socket 114 with the docking port 112 reduces the need of human intervention in connecting the docking port and the docking socket when the component 116 is lowered into the quenching tank 102. Thus, the time taken to transfer the component 116 from heat treatment apparatus to the quenching tank can be kept as short as possible.

So far, the invention has been described in terms of individual embodiments. However, those skilled in the art will appreciate that various embodiments of the invention, or features from one or more embodiments, may be combined as required. It will be appreciated that various modifications may be made to these embodiments without departing from the scope of the invention, which is defined by the appended claims.

The invention claimed is:

1. A quenching agent delivery apparatus for delivering a quenching agent to a component having an inner surface, wherein the apparatus is elongate and defines a longitudinal axis, the apparatus comprising:

an inlet through which the quenching agent is configured to be delivered into the apparatus;

a first outlet opposite the inlet and configured to deliver a first portion of the quenching agent in a first direction substantially along the longitudinal axis of the delivery apparatus to the inner surface of the component;

a second outlet located between the inlet and the first outlet and configured to deliver a second portion of the quenching agent in a second direction at an angle in the range of 45-90° relative to the longitudinal axis to the inner surface of the component; and a deflector located within the apparatus, between the inlet and the first and second outlets, the deflector comprising a deflector plate inclined at an angle of approximately 45° with respect to the longitudinal axis of the delivery apparatus, the deflector plate having at least one aperture arranged to allow a first portion of the quenching agent to flow along the longitudinal axis through the aperture and beyond the deflector plate to the first outlet, the remainder of the deflector plate arranged to deflect a second portion of the of the quenching agent to the second outlet.

2. The quenching agent delivery apparatus according to claim 1, wherein the at least one aperture is configured to allow between around 15 percent and 30 percent of quenching agent flowing into the apparatus via the inlet to be delivered to, and exit the apparatus through, the first outlet.

3. The quenching agent delivery apparatus according to claim 1, wherein the at least one aperture comprises a single circular aperture.

4. The quenching agent delivery apparatus according to claim 1, further comprising a seal formed around a periphery of the apparatus, the seal being configured such that, when the apparatus is installed in a component, the amount of quenching agent able to flow between the apparatus and component is restricted.

5. A quenching system comprising:

a quenching tank configured to contain a quenching agent;

a conduit configured to transport the quenching agent; and a quenching agent delivery apparatus connected to a first end of the conduit, the quenching agent delivery apparatus defining a longitudinal axis and comprising:

an inlet configured to receive the quenching agent;

a first outlet opposite the inlet and configured to deliver a first portion of the quenching agent in a first direction substantially along the longitudinal axis of the delivery apparatus to an inner surface of a component having the inner surface;

a second outlet located between the inlet and the first outlet and configured to deliver a second portion of the quenching agent in a second direction at an angle in the range of 45-90° relative to the longitudinal axis to the inner surface of the component, and a deflector located within the quenching agent delivery apparatus, between the inlet and the first and second outlets, the deflector comprising a deflector plate inclined at an angle of approximately 45° with respect to the longitudinal axis of the delivery apparatus, the deflector plate having at least one aperture arranged to allow the first portion of the quenching agent to flow along the longitudinal axis through the aperture and beyond the deflector plate to the first outlet, the remainder of the deflector plate arranged to deflect the second portion of the of the quenching agent to the second outlet.

6. The quenching system according to claim 5, wherein the quenching agent delivery apparatus is configured to remain stationary relative to the component during quenching.

7. The quenching system according to claim 5, wherein the quenching agent delivery apparatus comprises a seal sized to allow a predetermined amount of quenching agent to pass between the component and the delivery apparatus.

8. The quenching system according to claim 5, further comprising a pump for pumping the quenching agent through the conduit.

9. The quenching system according to claim 8, further comprising a coupler for coupling the conduit between the pump and the quenching agent delivery apparatus, the coupler comprising a docking socket connected to the quenching agent delivery apparatus and a docking port connected to the conduit, the docking socket being arranged to receive the docking port.

10. A method of quenching a component having an inner surface, the method comprising:

inserting at least partially into the component a quenching agent delivery apparatus defining a longitudinal axis and comprising:

an inlet through configured to receive a quenching agent;

a first outlet opposite the inlet and configured to deliver a first portion of the quenching agent in a first direction substantially along the longitudinal axis of the delivery apparatus to the inner surface of the component;

a second outlet located between the inlet and the first outlet and configured to deliver a second portion of the quenching agent in a second direction at an angle in the range of 45-90° relative to the longitudinal axis to the inner surface of the component, and a deflector located within the quenching agent delivery apparatus, between the inlet and the first and second outlets, the deflector comprising a deflector plate inclined at an angle of approximately 45° with respect to the longitudinal axis of the delivery apparatus, the deflector plate having at least one aperture arranged to allow the first portion of the quenching agent to flow beyond the deflector plate to the first outlet, the remainder of the deflector plate arranged to deflect the second portion of the of the quenching agent to the second outlet;

connecting the quenching agent delivery apparatus to a conduit through which the quenching agent is configured to flow;

placing the component and the quenching agent delivery apparatus into a quenching tank containing the quenching agent; and pumping the quenching agent through the conduit and the quenching agent delivery apparatus into the component via the first outlet and the second outlet.

11. The method of claim 10, wherein the at least one aperture is configured to allow between around 15 percent and 30 percent of quenching agent flowing into the apparatus via the inlet to be delivered to, and exit the apparatus through, the first outlet.

12. The method of claim 10, wherein the at least one aperture comprises a single circular aperture.

13. The method of claim 10, wherein the least one aperture is arranged to allow the first portion of the quenching agent to flow along the longitudinal axis through the aperture and beyond the deflector plate to the first outlet.

* * * * *